US006876151B2

(12) United States Patent
Seki et al.

(10) Patent No.: US 6,876,151 B2
(45) Date of Patent: Apr. 5, 2005

(54) DISCHARGE LAMP AND LAMP UNIT

(75) Inventors: Tomoyuki Seki, Osaka (JP); Makoto Horiuchi, Nara (JP); Makoto Kai, Osaka (JP); Tsuyoshi Ichibakase, Osaka (JP); Mamoru Takeda, Kyoto (JP); Shinichi Yamamoto, Osaka (JP); Kenichi Sasaki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/824,481

(22) Filed: Apr. 2, 2001

(65) Prior Publication Data

US 2002/0021092 A1 Feb. 21, 2002

(30) Foreign Application Priority Data

Apr. 3, 2000 (JP) ..... 2000-100669

(51) Int. Cl.[7] ..... H01J 61/36; H01J 17/18

(52) U.S. Cl. ..... 313/623; 313/634; 313/631

(58) Field of Search ..... 313/623–626, 313/631, 634; 445/26, 25, 43

(56) References Cited

U.S. PATENT DOCUMENTS

| | | | | |
|---|---|---|---|---|
| 4,110,657 A | | 8/1978 | Sobieski | |
| 4,677,338 A | * | 6/1987 | Dixon et al. | 313/43 |
| 4,749,905 A | * | 6/1988 | Mori et al. | 313/623 |
| 5,598,063 A | * | 1/1997 | Mathews et al. | 313/623 |
| 5,877,591 A | | 3/1999 | Nagata et al. | |
| 5,932,955 A | | 8/1999 | Berger et al. | |
| 6,135,840 A | | 10/2000 | Kanzaki | |
| 6,208,070 B1 | * | 3/2001 | Sugimoto et al. | 313/493 |
| 6,239,539 B1 | * | 5/2001 | Mochiduki et al. | 313/318.01 |
| 6,274,973 B1 | * | 8/2001 | Mochiduki et al. | 313/318.09 |
| 6,294,861 B1 | * | 9/2001 | Mochiduki et al. | 313/318.01 |
| 6,580,200 B2 | * | 6/2003 | Fukuyo et al. | 313/25 |
| 6,750,612 B2 | * | 6/2004 | Takagaki et al. | 313/634 |

FOREIGN PATENT DOCUMENTS

| | | |
|---|---|---|
| CN | 1157055 A | 9/1997 |
| CN | 1159652 A | 9/1997 |
| EP | 0 866 488 A1 | 9/1998 |
| EP | 0 877 412 A1 | 11/1998 |
| GB | 2 332 300 A | 6/1999 |
| JP | 40-34793 B | 4/1964 |
| JP | 62098553 A | 5/1987 |
| JP | 62170144 | 7/1987 |
| JP | 2000223072 A | 1/1999 |
| JP | 11067154 A | 3/1999 |
| JP | 11154492 A | 6/1999 |
| JP | 2000223023 A | 8/2000 |
| JP | 2000348680 A | 12/2000 |
| WO | WO 96/34405 | 10/1996 |
| WO | WO99/50887 | 10/1999 |

OTHER PUBLICATIONS

State Intellectual Property Office of People's Republic of China, The First Action for Patent Application No. 01110235.7; Issued Apr. 30, 2004; and English Translation.

* cited by examiner

*Primary Examiner*—Kamand Cuneo
*Assistant Examiner*—Dameon E. Levi
(74) *Attorney, Agent, or Firm*—Harness, Dickey & Pierce, P.L.C.

(57) ABSTRACT

A discharge lamp includes a luminous bulb in which a luminous material is enclosed and a pair of electrodes are opposed in the luminous bulb; and a pair of sealing portions for sealing a pair of metal foils electrically connected to the pair of electrodes, respectively. At least one of the pair of sealing portions is provided with at least one constricted portion whose length in a thickness direction of the metal foil in the sealing portion is smaller than that of other portions in the sealing portion.

13 Claims, 9 Drawing Sheets

DISCHARGE LAMP AND LAMP UNIT

BACKGROUND OF THE INVENTION

The present invention relates to a discharge lamp and a lamp unit. In particular, a discharge lamp and a lamp unit used as a light source for an image projection apparatus such as a liquid crystal projector and a digital micromirror device (DMD) projector.

In recent years, an image projection apparatus such as a liquid crystal projector and a DMD projector has been widely used as a system for realizing large-scale screen images, and a high-pressure discharge lamp having a high intensity has been commonly and widely used in such an image projection apparatus. In the image projection apparatus, light is required to be concentrated on a very small area of a liquid crystal panel or the like, so that in addition to high intensity, it is also necessary to achieve nearly a point light source. Therefore, among high-pressure discharge lamps, a short arc type ultra high pressure mercury lamp that is nearly a point light and has a high intensity has been noted widely as a promising light source.

Referring to FIGS. 8A to 8C, a conventional short arc type ultra high pressure mercury lamp 1000 will be described.

FIG. 8A is a schematic top view of a lamp 1000. FIG. 8B is a schematic side view of a lamp 1000. FIG. 8C is a cross-sectional view taken along line c–c' of FIG. 8A.

The lamp 1000 includes a substantially spherical luminous bulb 110 made of quartz glass, and a pair of sealing portions (seal portions) 120 and 120' made of also quartz glass and connected to the luminous bulb 110. A discharge space 115 is inside the luminous bulb 110. A mercury 118 in an amount of the enclosed mercury of, for example, 150 to 250 mg/cm$^3$ as a luminous material, a rare gas (e.g., argon with several tens kPa) and a small amount of halogen are enclosed in the discharge space 115.

A pair of tungsten electrodes (W electrode) 112 and 112' are opposed with a certain gap in the discharge space 115, and a coil 114 is wound around the end of the W electrode 112 (or 112'). An electrode axis 116 of the W electrode 112 is welded to a molybdenum foil (Mo foil) 124 in the sealing portion 120, and the W electrode 112 and the Mo foil 124 are electrically connected by a welded portion 117 where the electrode axis 116 and the Mo foil 124 are welded.

The sealing portion 120 includes a glass portion 122 extended from the luminous bulb 110 and the Mo foil 124. The cross-sectional shape of the sealing portion 120 is circular, as shown in FIG. 8C. In the sealing portion 120, the glass portion 122 and the Mo foil 124 are attached tightly so that the airtightness in the discharge space 115 in the luminous bulb 110 is maintained. The principle of the reason why the luminous bulb 110 can be sealed by the sealing portion 120 will be briefly described below.

Since the thermal expansion coefficient of the quartz glass constituting the glass portion 122 is different from that of the molybdenum constituting the Mo foil 124, the glass portion 122 and the Mo foil 124 are not integrated. However, by plastically deforming the Mo foil 124, the gap between the Mo foil 124 and the glass portion 122 can be filled. Thus, the Mo foil 124 and the glass portion 122 are attached to each other, and the luminous bulb 110 can be sealed with the sealing portion 120. In other words, the sealing portion 120 is sealed by attaching the Mo foil 124 and the glass portion 122 tightly for foil-sealing. Since the glass portion 122 and the electrode axis 116 of the W electrode 112 are not attached tightly to each other, a gap (not shown) is generated between the glass portion 122 and the electrode axis 116 by a difference in the thermal expansion coefficient.

The Mo foil 124 attached to the glass portion 122 of the sealing portion 120 has a rectangular planar shape, and is positioned in the center of the sealing portions 120 and 120', as shown in FIG. 8C. The Mo foil 124 includes an external lead (Mo rod) 130 made of molybdenum on the side opposite to the side on which the welded portion 117 is positioned. The Mo foil 124 and the external lead 130 are welded to each other so that the Mo foil 124 and the external lead 130 are electrically connected at a welded portion 132. The external lead 130 is electrically connected to a member (not shown) positioned in the periphery of the lamp 1000.

Next, the operational principle of the lamp 1000 will be described. When a start voltage is applied to the W electrodes 112 and 112' via the external leads 130 and the Mo foils 124, discharge of argon (Ar) occurs. Then, this discharge raises the temperature in the discharge space 115 of the luminous bulb 110, and thus the mercury 118 is heated and evaporated. Thereafter, mercury atoms are excited and become luminous in the arc center between the W electrodes 112 and 112'. As the pressure of the mercury vapor of the lamp 1000 is higher, the emission efficiency is higher, so that the higher pressure of the mercury vapor is suitable as a light source for an image projection apparatus. However, in view of the physical strength against pressure of the luminous bulb 110, the lamp 1000 is used at a mercury vapor pressure of 15 to 25 MPa.

As a result of in-depth research, the inventors of the present invention found that the lifetime of the conventional lamp 1000 is shortened by the fact that the sealing structure of the sealing portions 120 is destroyed.

More specifically, the cross-sectional shape of the sealing portions 120 of the lamp 1000 is circular, so that the length of the sealing portion 120 in the thickness direction is constant (in other words, the thickness of the glass portion 122 of the sealing portion 120 is constant). In addition, since the sealing portion 120 is sealed by the attachment between the Mo foil 124 and the glass portion 122, as shown in FIGS. 9A and 9B, an internal stress 40 (from the glass portion 122) occurs uniformly on the Mo foil 124 in the direction perpendicular to the surface of the foil (the Z direction in FIGS. 9A and 9B). For this reason, as shown in FIG. 9C, when expansion and contraction of the Mo foil 124 are repeated with use of the lamp 1000, the gap 119 between the glass portion 122 on the luminous bulb 110 side and the electrode axis 116 proceeds in the direction shown by an arrow 119*a* (i.e., the longitudinal direction of the Mo foil 124) between the glass portion 122 and the Mo foil 124 that are simply attached. When the gap 119 proceeds and reaches the welded portion 132 between the Mo foil 124 and the external lead 130, the entire Mo foil 124 is oxidized. Thus, the conductivity of the Mo foils 124 is lost, so that the lamp 1000 stops its operation.

To deal with compactness of the lamp size corresponding to compactness of image projection apparatuses, reducing the size of the sealing portion 120 is in demand. To meet this demand, when the size of the sealing portion 120 is reduced, as shown in FIG. 9B, the thickness T of the glass between the side face 124*a* of the Mo foil 124 and the surface 122*a* of the glass portion 122 becomes small. Therefore, a crack 45 proceeding from the side face 124*a* of the Mo foil 124 reaches the surface 122*a* of the glass portion 122, so that the sealing structure of the sealing portion 120 can be destroyed.

SUMMARY OF THE INVENTION

Therefore, with the foregoing in mind, it is a main object of the present invention to provide a discharge lamp having a long lifetime in which the sealing structure of the sealing portions can be maintained for a long period.

A discharge lamp of the present invention includes a luminous bulb in which a luminous material is enclosed and a pair of electrodes are opposed in the luminous bulb; and a pair of sealing portions for sealing a pair of metal foils electrically connected to the pair of electrodes, respectively; wherein at least one of the pair of sealing portions is provided with at least one constricted portion whose length in a thickness direction of the metal foil in the sealing portion is smaller than that of other portions in the sealing portion.

It is preferable that at least one of the constricted portions is provided in a portion on the luminous bulb side than a center of the sealing portion.

It is preferable that a plurality of constricted portions are formed on the sealing portion.

Furthermore, it is preferable that each of the pair of metal foils includes an external lead on a side opposite to a side electrically connected to a corresponding electrode of the pair of electrodes, and at least one of the constricted portions is formed in an area between an end of the electrode and an end of the external lead of at least one of the sealing portions.

According to another aspect of the present invention, a discharge lamp includes a luminous bulb in which a luminous material is enclosed and a pair of electrodes are opposed in the luminous bulb; and a pair of sealing portions for sealing a pair of metal foils electrically connected to the pair of electrodes, respectively; wherein at least one of the pair of sealing portions is provided with at least one oblate cross-section portion in which a length in a direction perpendicular to a thickness direction of the metal foil in the sealing portion is larger than that in the thickness direction in the sealing portion.

In one embodiment, the cross-sectional shape of the oblate cross-section portion is a substantially ellipse having a minor axis in the thickness direction of the metal foil and a major axis in a direction perpendicular to the thickness direction.

It is preferable that the oblate cross-section portion is provided in a portion on the luminous bulb side than a center of the sealing portion.

It is preferable that the oblate cross-section portion is formed in the entire sealing portion.

It is preferable that each of the pair of sealing portions has a shrink seal structure.

It is preferable that the ends of the pair of sealing portions on a side opposite to the luminous bulb side are tapered.

In one embodiment, each of the pair of metal foils is attached tightly to a glass portion extended from the luminous bulb, and each of the pair of metal foils is a molybdenum foil.

In one embodiment, the luminous material comprises at least mercury.

A lamp unit of the present invention includes the above-described discharge lamp and a reflecting mirror for reflecting light emitted from the discharge lamp.

A method for producing a discharge lamp of one embodiment of the present invention includes (a) preparing a pipe for a discharge lamp including a luminous bulb portion for a luminous bulb for a discharge lamp and a side tube portion extending from the luminous bulb portion; and an electrode assembly including a metal foil, an electrode connected to the metal foil, and an external lead connected to the metal foil on a side opposite to a side connected to the electrode; (b) inserting the electrode assembly into the side tube portion so that an end of the electrode is positioned inside the luminous bulb portion; (c) attaching the side tube portion to the metal foil by reducing a pressure in the pipe for a discharge lamp and heating and softening the side tube portion after the step (b); and (d) forming a constricted portion in the side tube portion. In one embodiment, the step (d) is performed by pulling the side tube portion to the external lead side.

Hereinafter, the functions of the present invention will be described.

According to a discharge lamp of the present invention, a constricted portion whose length in the thickness direction of the metal foil is smaller than that of other portions in the sealing portion is formed in the sealing portion. Therefore, the internal stress (from the glass portion) to the surface of the metal foil in the sealing portion in the constricted portion can be smaller than that in the other portions. For this reason, the internal stress from the metal foil in the constricted portion can be relatively larger than that in the other portions, so that the metal foil can be deformed (thermally expanded) selectively in the constricted portion. As a result, the metal foil in the constricted portion can stop the gap from proceeding in the sealing portion. Thus, compared with the prior art, the sealing structure of the sealing portion can be maintained for a long time. If the constricted portion is provided in a portion on the luminous bulb side than the center of the sealing portion, the proceeding of the gap in the sealing portion can be stopped more effectively. It is preferable to form a plurality of constricted portions, because the proceeding of the gap in the sealing portion can be stopped in a plurality of points. Furthermore, when the constricted portion is formed in an area between the end of the electrode and the end of the external lead of the sealing portion, it is possible to avoid reduction of the connection strength between the electrode and the metal foil and the connection strength between the external lead and the metal foil.

Another discharge lamp of the present invention is provided with a portion having an oblate cross-sectional shape (hereinafter, referred to as "oblate cross-section portion") in which the length in the direction perpendicular to the thickness direction of the metal foil in the sealing portion is larger than that in the thickness direction. This makes it difficult for a crack proceeding from the side face of the metal foil to reach the surface of the sealing portion over the prior art. As a result, the sealing structure of the sealing portion can be maintained for a long time over the prior art. The cross-sectional shape of the oblate cross-section portion can be, for example, a substantially elliptic shape having its minor axis in the thickness direction of the metal foil and its major axis in the direction perpendicular to the thickness direction. Cracks are likely to occur on the luminous bulb side in which the temperature is changed significantly, so that when the oblate cross-section portion is provided in a portion on the luminous bulb side than the center of the sealing portion, the sealing structure of the sealing portion can be prevented from being destroyed by cracks effectively. Furthermore, for example, the cross-sectional shape of the entire sealing portion is a substantially elliptic shape and the entire sealing portion can be constituted by the oblate cross-section portion.

It is preferable that each of the pair of sealing portions has the shrink seal structure to improve the resistance to pressure. Examples of the discharge lamp of the present invention include a mercury lamp comprising at least mercury as a luminous material (including ultra high pressure mercury lamp, high pressure mercury lamp and low pressure mercury lamp). The discharge lamp of the present invention can form a lamp unit in combination with a reflecting mirror.

According to a discharge lamp of the present invention, at least one of a pair of sealing portions has the constricted portion, so that the sealing structure of the sealing portion can be maintained for a long time, and the lifetime of the lamp can be prolonged. According to another discharge lamp of the present invention, at least one of a pair of sealing portions has the oblate cross-section portion, so that the sealing structure of the sealing portion can be maintained for a long time, and the lifetime of the lamp can be prolonged.

This and other advantages of the present invention will become apparent to those skilled in the art upon reading and understanding the following detailed description with reference to the accompanying figures.

DETAILED DESCRIPTION OF THE INVENTION

Figure 1A:
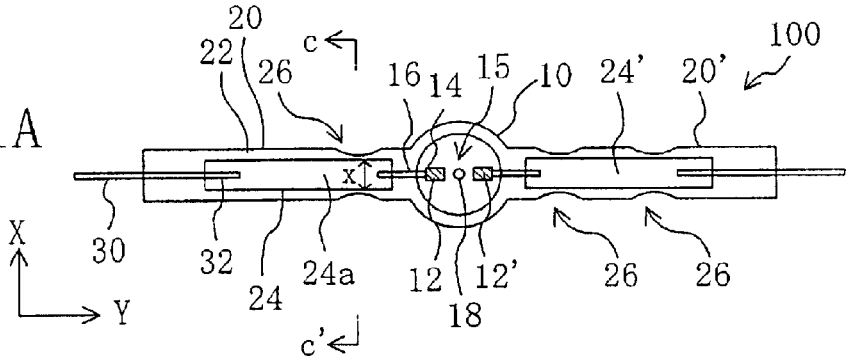
FIG. 1A is a schematic top view showing a structure of a discharge lamp 100 of Embodiment 1.

Hereinafter, embodiment of the present invention will be described with reference to the accompanying drawings. In the following drawings, the elements having substantially the same functions bear the same reference numeral.

EMBODIMENT 1

A discharge lamp 100 of Embodiment 1 of the present invention will be described with reference to FIGS. 1 to 4.

Figure 1B:
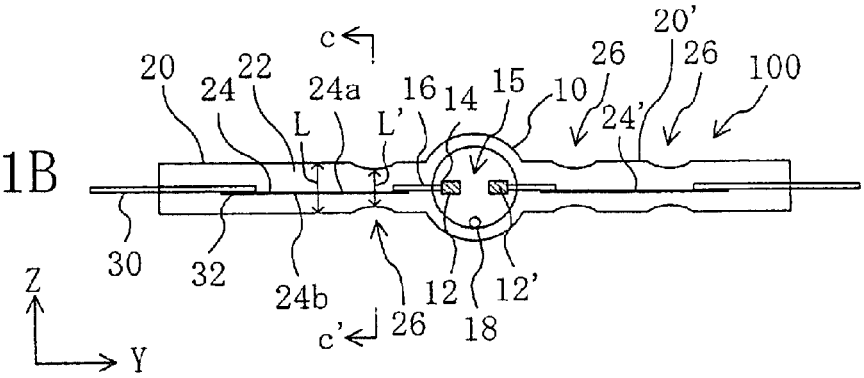
FIG. 1B is a schematic side view showing a structure of a discharge lamp 100 of Embodiment 1.
Figure 1C:
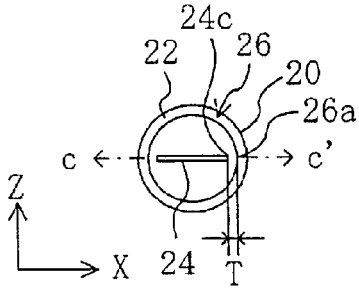
FIG. 1C is a cross-sectional view taken along line c–c' of FIG. 1A.
Figure 1D:
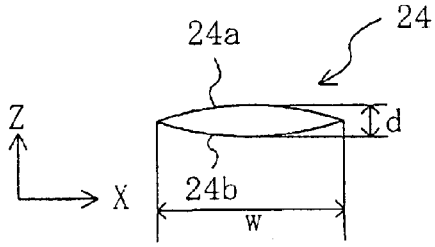
FIG. 1D is a schematic enlarged view showing the shape of an end face of a metal foil 24.

First, FIGS. 1A to 1D are referred to. FIG. 1A is a schematic top view showing a discharge lamp 100 of Embodiment 1. FIG. 1B is a schematic side view showing the discharge lamp 100. FIG. 1C is a cross-sectional view taken along line c–c' of FIG. 1A. FIG. 1D is a schematic enlarged view showing the shape of an end face of a metal foil 24. The arrows X, Y and Z in FIGS. 1A to 1D show the coordinate axes.

The discharge lamp 100 of Embodiment 1 includes a luminous bulb 10, and a pair of sealing portions 20 and 20' connected to the luminous bulb 10.

A discharge space 15 in which a luminous material 18 is enclosed is provided inside the luminous bulb 10. A pair of electrodes 12 and 12' are opposed to each other in the discharge space 15. The luminous bulb 10 is made of quartz glass and is substantially spherical. The outer diameter of the luminous bulb 10 is, for example, about 5 mm to 20 mm. The glass thickness of the luminous bulb 10 is, for example, about 1 mm to 5 mm. The volume of the discharge space 15 in the luminous bulb 10 is, for example, about 0.01 to 1.0 cc. In this embodiment, the luminous bulb 10 having an outer diameter of about 13 mm, a glass thickness of about 3 mm, a volume of the discharge space 15 of about 0.3 cc is used. As the luminous material 18, mercury is used. For example, about 150 to 200 mg/cm$^3$ of mercury, a rare gas (e.g., argon) with 5 to 20 kPa, and a small amount of halogen are enclosed in the discharge space 15. In FIGS. 1A and 1B, mercury 18 attached to the inner wall of the luminous bulb 10 is schematically shown.

The pair of electrodes 12 and 12' in the discharge space 15 are arranged with a gap (arc length) of, for example, about 1 to 5 mm. As the electrodes 12 and 12', for example, tungsten electrodes (W electrodes) are used. In this embodiment, the W electrodes 12 and 12' are arranged with a gap of about 1.5 mm. A coil 14 is wounded around the end of each of the electrodes 12 and 12'. The coil 14 has a function to lower the temperature of the electrode end. An electrode axis (W rod) 16 of the electrode 12 is electrically connected to the metal foil 24 in the sealing portion 20. Similarly, an electrode axis 16 of the electrode 12' is electrically connected to the metal foil 24' in the sealing portion 20'.

The sealing portion 20 includes a metal foil 24 electrically connected to the electrode 12 and a glass portion 22 extended from the luminous bulb 10. The airtightness in the discharge space 15 in the luminous bulb 10 is maintained by the foil-sealing between the metal foil 24 and the glass portion 22. In other words, the sealing portion 20 is a portion foil-sealed by the metal foil 24 and the glass portion 22. The metal foil 24 is a molybdenum foil (Mo foil), for example, and has a rectangular shape, for example. The glass portion 22 is made of quartz glass, for example.

As shown in FIG. 1D, the thickness d of the metal foil 24 is about 20 $\mu$m to 30 $\mu$m. The width w of the metal foil 24 is for example, about 1.5 mm to 2.5 mm. The ratio of the thickness d to the width w is about 1:100. In this embodiment, as shown in FIG. 1D, the side of the metal foil 24 is sharp. This design is adopted to prevent a gap from being generated between the metal foil 24 and the glass portion 22 and the internal stress occurring perpendicularly to the side face of the metal foil 24 from being directed to a direction x (X direction) perpendicular to the thickness direction of the foil as much as possible, so that cracks are prevented from occurring in the direction x (X direction) perpendicular to the thickness direction as much as possible.

It is preferable that the sealing portion 20 has a shrink seal structure for the following reason. In production of the sealing portion of the shrink seal structure, after the glass tube is heated and sealed, self-cooling is performed. Therefore, the residual stress (strain) is prevented from occurring in the glass portion 22 of the sealing portion 20, and thus the resistance to sealing pressure can be improved. The metal foil 24 of the sealing portion 20 is joined with the electrode 12 by welding, and the metal foil 24 includes an external lead 30 on the side opposite to the side where the electrode 12 is joined. The external lead 30 is made of, for example, molybdenum. This design of the sealing portion 20 applies to the sealing portion 20', so that further description is omitted.

At least one sealing portion 20 of the pair of sealing portions includes at least one constricted portion 26. The constricted portion 26 is a portion whose length in the thickness direction (Z direction) of the metal foil 24 of the sealing portion 20 is smaller than that of other portions of the sealing portion 20 (e.g., a portion adjacent to the constricted portion 26). In other words, in the constricted portion 26, the thickness of the glass portion 22 in the thickness direction of the metal foil 24 is smaller than that of the other portions. As shown in FIG. 1B, the constricted portion 26 is depressed from the portions adjacent to the constricted portion 26, and the length L' of the constricted portion 26 in the thickness direction (Z direction) is shorter than the length L of the other portions in the sealing portion 20. The length L' of the constricted portion 26 in the thickness direction can be, for example, 70 to 90% of the length L of the other portions.

In the area of the sealing portion 20 in which the metal foil 24 is disposed, the constricted portion 26 is a portion in which the contour of the sealing portion 20 is depressed and then the length in the thickness direction is increased from that of the depressed portion. Therefore, as shown in FIG. 1C, when the cross-sectional shapes of the sealing portion 20 and the constricted portion 26 are circular, the outer diameter of the constricted portion 26 is smaller than that of the other portions.

In this embodiment, the outer diameter of the constricted portion 26 is, for example, about 7 mm, and the outer diameter of the portions other than the constricted portion 26 is, for example, about 8 mm. In order to make it difficult for cracks proceeding from the side face 24*c* of the metal foil 24 to reach the surface 26*a* of the constricted portion 26, it is preferable that the thickness T of the glass portion 22 from the side face 24*c* of the metal foil 24 to the surface 26*a* of the constricted portion 26 is, for example, about 2 mm or more. The cross-sectional shape of the constricted portion 26 is not limited to a circle, and it can be for example, substantially an ellipse. Furthermore, in the discharge lamp 100 of the present invention, one sealing portion 20 has one constricted portion 26, and the other sealing portion 20' has a plurality of constricted portions 26.

Figure 2A:
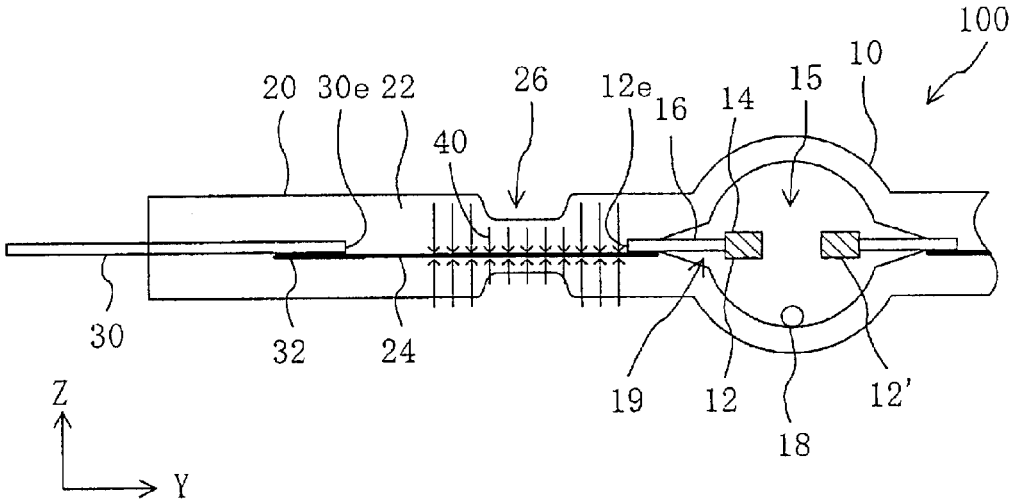
FIG. 2 is an enlarged cross-sectional view showing a constricted portion of a sealing portion.
Figure 2B:
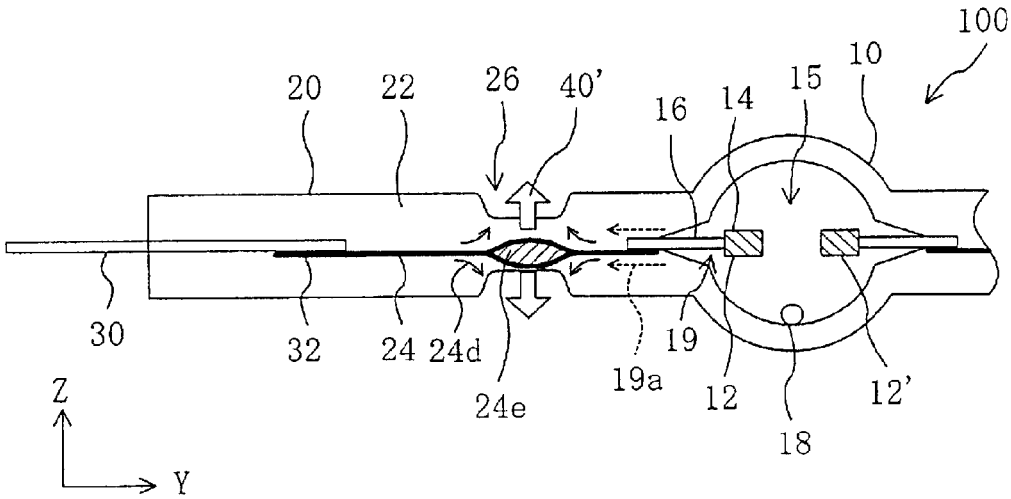

Next, FIGS. 2A and 2B are referred to. FIGS. 2A and 2B are schematic enlarged views showing the constricted portion 26 of the sealing portion 20.

As shown in FIG. 2A, when the sealing portion 20 has the constricted portion 26, the internal stress 40 applied from the glass portion 22 perpendicularly to the metal foil 24 can be smaller in the constricted portion 26 than that in the other portions. This is because in the constricted portion 26, the thickness of the glass portion 22 is smaller than that of the other portions, so that the stress applied from the glass portion 22 to the metal foil 24 is smaller than that of the other portions. Therefore, as shown in FIG. 2B, since the internal stress 40' applied from the metal foil 24 to the glass portion 22 is relatively larger in the constricted portion 26 than that in the other portions, the metal foil 24 is deformed, as shown by an arrow 24*d*, and an expanded portion 24*e* is generated in the metal foil 24 in the constricted portion 26. As a result, the expanded portion 24*e* of the metal foil 24 can stop the gap 19 from proceeding in the direction of an arrow 19*a*, and the entire metal foil 24 is prevented from being oxidized. In other words, the sealing structure of the sealing portion can be maintained for a long time over the prior art by allowing the metal foil 24 positioned in the constricted portion 26 to act as a portion for stopping gap proceeding 24*e*.

It is preferable that the constricted portion 26 is formed in an area between the end 12*e* of the electrode 12 and the end 30*e* of the external lead 30 of the sealing portion 20 (glass portion 22) for the following reason. When the constricted portion 26 is formed in this area, the constricted portion 26 is positioned in a portion other than the welded portions between the electrode 12 and the external lead 30 and the metal foil 24. Therefore, it is possible to avoid reduction of the connection strength between the electrode 12 and the metal foil 24 and the connection strength between the external lead 30 and the metal foil 24.

It is preferable to form the constricted portion 26 on the side connected to the luminous bulb 10 than the center of the sealing portion 20, as shown in FIGS. 1A and 1B, for the following reason. Since the proceeding of the gap 19 starts from the luminous bulb 10 side, the proceeding of the gap 19 can be stopped in an earlier stage. For example, it is sufficient that at least a part of the bottom face of the constricted portion 26 is positioned in a portion on the luminous bulb 10 side from the midpoint of the metal foil 24 along the longitudinal direction (Y direction) of the sealing portion 20 (glass portion 22). Furthermore, it is more preferable to form a plurality of constricted portions 26, as in the sealing portion 20', because the proceeding of the gap 19 can be stopped at a plurality of points.

In this embodiment, both of the pair of sealing portions have the constricted portion 26. However, when at least one sealing portion has the constricted portion 26, the proceeding of the gap 19 can be stopped and the sealing structure of the sealing portion can be maintained for a long time over the prior art. For example when the discharge lamp 100 is set to a reflecting mirror, the constricted portion 26 can be formed only in the sealing portion on the side of the direction to which light exits (on the side of the front opening of the reflecting mirror) where significant temperature change occurs.

Figure 3A:
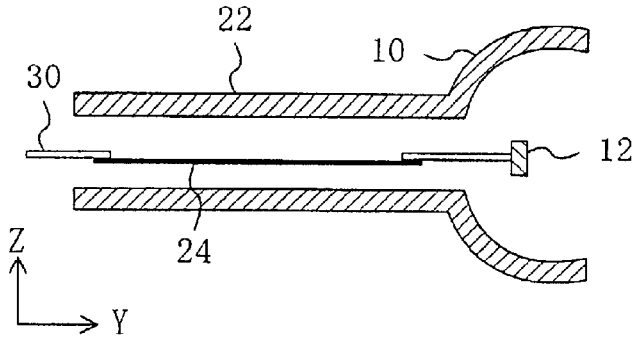
FIGS. 3A to 3C are cross-sectional views of a process sequence for illustrating a method for producing the discharge lamp 100 of Embodiment 1.
Figure 3B:
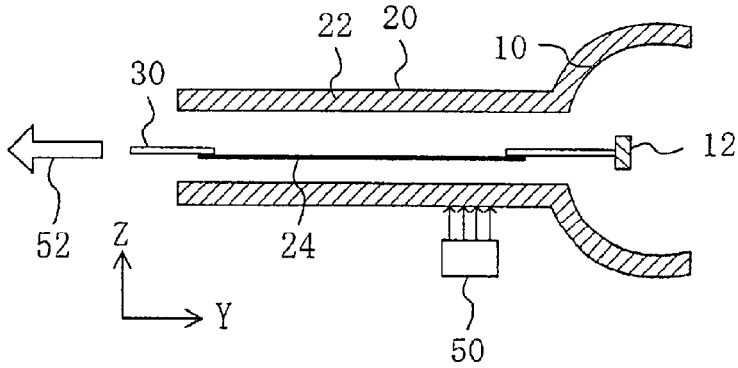
Figure 3C:
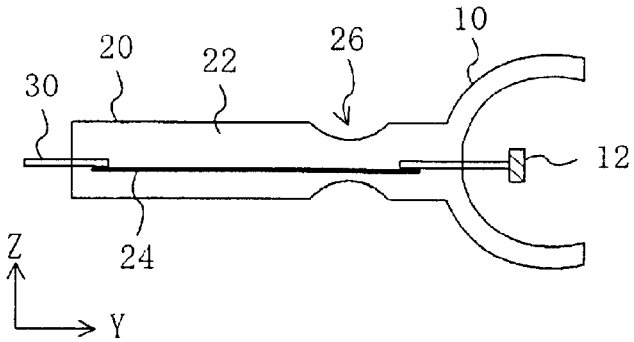

Next, a method for producing the discharge lamp 100 will be described with reference to FIGS. 3A to 3C. FIGS. 3A to 3C are cross-sectional views showing each process in a method for producing the discharge lamp 100.

First, as shown in FIG. 3A, the metal foil (Mo foil) 24 having the electrode 12 and the external lead 30 is inserted in a glass pipe for a discharge lamp having a portion for the luminous bulb 10 (luminous bulb portion) and a portion (side tube portion) for the glass portion 22 of the sealing portion (electrode insertion process). The metal foil 24 provided with the electrode 12 and the external lead 30 is referred to as "electrode assembly". It is preferable that the glass pipe for a discharge lamp used in this embodiment is made of high purity quartz glass comprising a very low level, for example, several ppm or less, preferably, 1 ppm or less each of alkali impurities (Na, K, Li) in order to prevent blackening and devitrification in the luminous bulb effectively. However, the present invention is not limited thereto.

Then, as shown in FIG. 3B, the pressure in the glass pipe is reduced (e.g., one atmospheric pressure or less), and the glass tube 22 is heated and softened, for example, with a burner 50, so that the glass tube (side tube portion) 22 and the metal foil 24 are attached so that the sealing portion 20 is formed (sealing portion formation process). At this time, in the state where the metal foil 24 and the glass tube (glass portion of the sealing portion 20) 22 are not attached yet, the sealing portion 20 is pulled in the direction of an arrow 52. Thus, a constriction is formed in the glass portion 22, so that the constricted portion 26 is formed in the sealing portion 20, as shown in FIG. 3C (constricted portion formation process). Thus, the discharge lamp 100 provided with the sealing portion 20 having the constricted portion 26 can be produced. When the glass tube 22 is heated and softened while the glass tube 22 is standing in the vertical direction, the glass tube 22 is extended by the weight of the glass tube 22 itself. In this manner, the constricted portion 26 can be formed easily by utilizing gravity.

The constricted portion 26 can be formed in the following manner as well. The entire metal foil 24 and the side tube portion 22 are attached to each other, and a portion in which a constriction is desired to be formed is heated and melted selectively. Then, the side tube portion 22 is pulled to the direction of the arrow 52 (the direction of the external lead side). Alternatively, after a portion in which a constriction is desired to be formed is heated and melted selectively, the portion is pinched so that the constricted portion 26 is formed.

Figure 4:
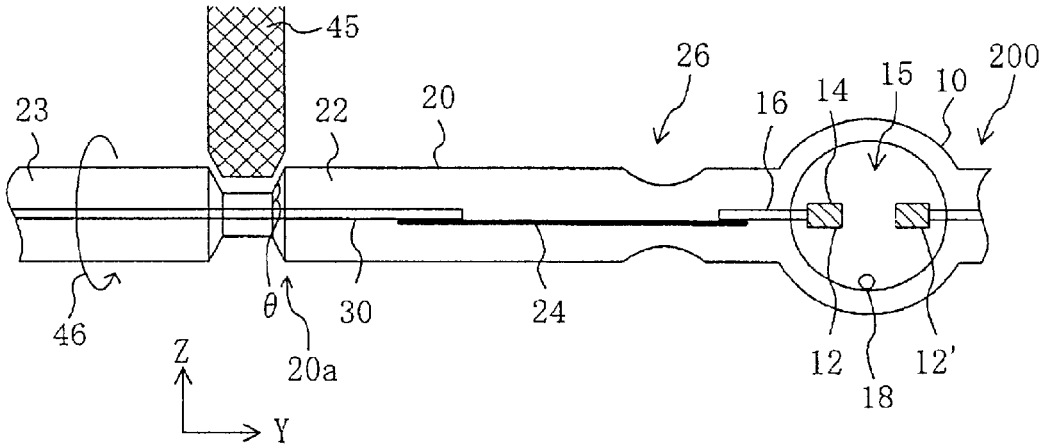
FIG. 4 is a cross-sectional view for illustrating a method for producing a discharge lamp 200 of Embodiment 1.

Furthermore, as shown in FIG. 4, after the constricted portion formation process, the glass portion 22 is further processed so that an end 20*a* of the sealing portion 20 is tapered. In this manner, a discharge lamp 200 can be produced. When the end 20*a* of the sealing portion 20 is tapered, the angle of the edge of the end 20*a* is changed from 90 degrees to an obtuse angle. Therefore, in the process of handling a plurality of discharge lamps (for example, in a washing process or the like), the edge of the end 20*a* of a discharge lamp is prevented from physically destroying a part of another discharge lamp (e.g., the glass portion 22 of the sealing portion 20), or that possibility is reduced. The taper angle θ of the end 20*a* of the sealing portion 20 can be for example, about 45 to 60 degrees.

In order to produce the tapered end 20*a*, for example, the glass portion 22 is ground with a grinder 44 while rotating the glass pipe provided with the constricted portion in the direction of an arrow 46. After grinding the glass portion 22, the ground portion of the glass is broken, for example, by hand with a care not to break the external lead 30, and an unnecessary portion 23 is removed. Thus, the discharge lamp 200 can be obtained.

In the discharge lamp of this embodiment, at least one of the pair of sealing portions has the constricted portion 26, and the metal foil 24 positioned in the constricted portion 26 can act as the gap proceeding stop portion 24*e*. As a result, the sealing structure of the sealing portion can be maintained for a long time over the prior art.

EMBODIMENT 2

A discharge lamp 300 of Embodiment 2 of the present invention will be described with reference to FIGS. 5A to 5C. The discharge lamp 300 of this embodiment is different from the discharge lamp 100 of Embodiment 1 provided with the sealing portion having the constricted portion 26, in that an oblate cross-section portion is formed in the sealing portion in Embodiment 2. For simplification of description of this embodiment, the points different from Embodiment 1 will be described in the following description, and description of the same points are either omitted or simplified.

Figure 5A:
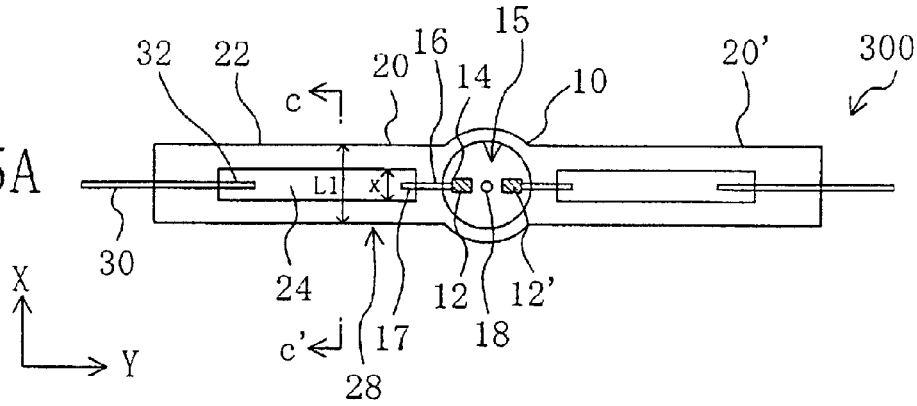
FIG. 5A is a schematic top view showing a structure of a discharge lamp 300 of Embodiment 2.
Figure 5B:
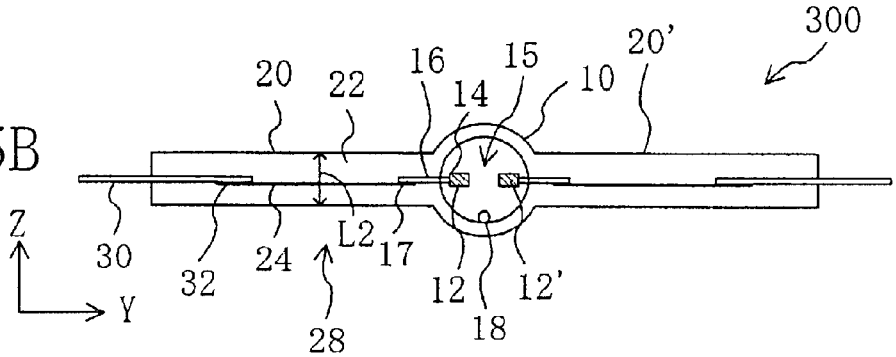
FIG. 5B is a schematic side view showing a structure of a discharge lamp 300 of Embodiment 2.

FIG. 5A is a schematic top view of the discharge lamp 300 of this embodiment. FIG. 5B is a schematic side view of the discharge lamp 300. FIG. 5C is a cross-sectional view taken along line c–c' of FIG. 5A.

The discharge lamp 300 of Embodiment 2 includes a luminous bulb 10, and a pair of sealing portions 20 and 20' connected to the luminous bulb 10. At least one of the pair of sealing portions 20 and 20' has at least one oblate cross-section portion 28. In the oblate cross-section portion 28, the length L1 in the direction x (or the X direction in FIGS. 5A) perpendicular to the thickness direction of the metal foil 24 in the sealing portion 20 is larger than the length L2 in the thickness direction (the Z direction in FIG. 5B). In this embodiment, the entire sealing portion 20 (or 20') is constituted by the oblate cross-section portion 28, and as shown in FIG. 5C, the cross-sectional shape of the oblate cross-section portion 28 has a substantially elliptic shape. In other words, the substantially elliptic oblate cross-section portion 28 having its minor axis 28*b* in the thickness direction of the metal foil 24 and its major axis 28*a* in the direction x perpendicular to the thickness direction is formed in the entire sealing portion 20.

When the sealing portion 20 has the oblate cross-section portion 28, the thickness T of the glass portion 22 from the side face 24*c* of the metal foil 24 to the surface 28*c* of the oblate cross-section portion 28 can be larger than that of a conventional discharge lamp having the same size. For this reason, it is difficult for cracks proceeding from the side face 24*c* of the metal foil 24 to reach the surface 28*c* of the oblate cross-section portion 28. As a result, the sealing structure of the sealing portion can be maintained for a long time over the prior art.

Furthermore, compared with the case where the cross-section of the sealing portion 20 is circular, the ratio of the length L2 in the thickness direction to the length L1 in the direction x perpendicular to the thickness direction can be small. Therefore, the internal stress applied from the glass portion 22 to the upper and lower surfaces of the metal foil 24 can be relatively small. Thus, the metal foil 24 is more likely to be deformed in the thickness direction, and the internal stress of the metal foil 24 can be stronger in the thickness direction. As a result, the internal stress applied from the side face 24*c* of the metal foil 24 to the glass portion 22 (internal stress from the metal foil 24 in the direction x perpendicular to the thickness direction) can be smaller than that of the case of the circular cross-section. Therefore, in the case of the sealing portions 20 having the same thickness T of the glass portion 22 from the side face 24*c* of the metal foil 24 to the surface 28*c* of the oblate cross-section portion 28, the substantially elliptic sealing portion 20 of this embodiment can maintain the sealing structure for a longer time than the sealing portion having a circular cross-section.

Figure 5C:
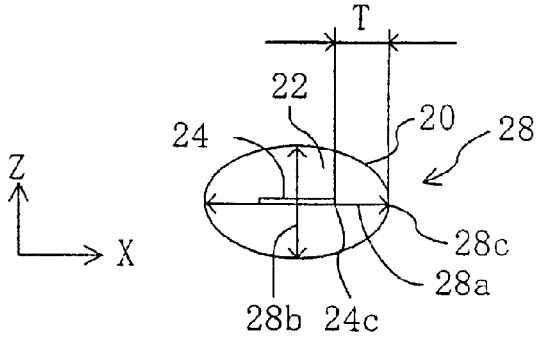
FIG. 5C is a cross-sectional view taken along line c–c' of FIG. 5A.

In this embodiment, as shown in FIG. 5C, the oblate cross-section portion 28 is constituted to have a cross-section having its minor axis 28*b* in the thickness direction of the metal foil 24 (Z direction in FIG. 5C) and its major axis 28*a* in the direction x perpendicular to the thickness direction (X direction in FIG. 5C). The ratio of the length (L1) of the major axis 28*a* to the length (L2) of the minor axis 28*b* is for example, 2:1. When L1 is about 16 mm and L2 is about 8 mm, the thickness T of the glass portion 22 from the side face 24*c* of the metal foil 24 to the surface 28*c* of the oblate cross-section portion 28 is about 6 mm in this embodiment.

Furthermore, even if the oblate cross-section portion is not formed in the entire sealing portion 20, the sealing structure of the sealing portion 20 can be maintained for a long time over the prior art, as long as the oblate cross-section portion 28 is formed in at least a part of the sealing portion 20. During operation of a lamp, a temperature change in the metal foil 24 is larger in a portion close to the luminous bulb 10 than that in a portion away from the luminous bulb 10, and therefore deformation (thermal expansion) of the metal foil occurring due to a temperature change is larger on the luminous bulb 10 side. As a result, cracks are likely to occur in the glass portion 22 on the luminous bulb 10 side. Therefore, when the oblate cross-section portion 28 is to be formed in a part of the sealing portion 20, it is preferable to form the oblate cross-section portion 28 in the luminous bulb 10 side than the center of the sealing portion 20. The constricted portion 26 of Embodiment 1 can be constituted as the oblate cross-section portion 28, or the constricted portion 26 and the oblate cross-section portion 28 can be formed independently in the sealing portion 20.

In this embodiment, both of the pair of sealing portions have the oblate cross-section portion 28. However, it is sufficient to form the oblate cross-section portion 28 in at least one of the pair of sealing portions to maintain the sealing structure of the sealing portion for a long time over the prior art.

Figure 6:
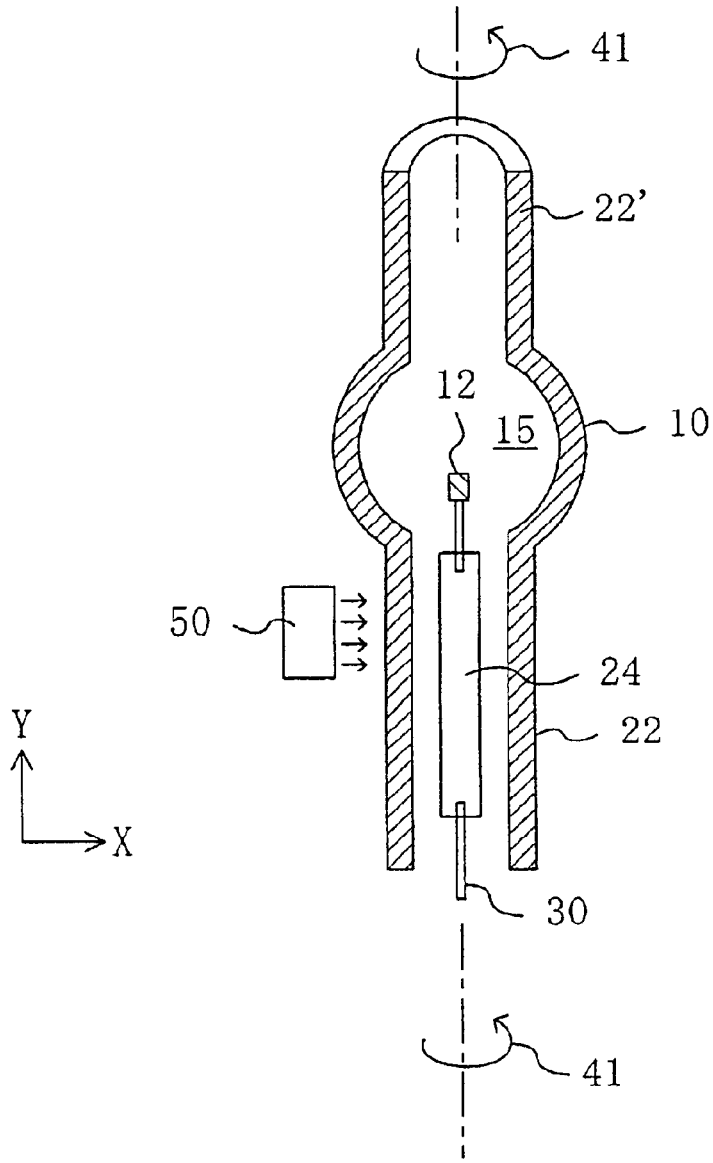
FIG. 6 is a cross-sectional view of a process sequence for illustrating a method for producing the discharge lamp 300 of Embodiment 2.

Next, a method for producing the discharge lamp 300 will be described. To obtain the discharge lamp 300, after the electrode insertion process (FIG. 3A) of Embodiment 1 is performed, the sealing portion formation process (FIG. 3B) is performed so that the length L1 of the direction (X direction) perpendicular to the thickness direction is larger than the length L2 of the thickness direction (Z direction). Hereinafter, the method will be described more specifically with reference to FIG. 6.

First, a glass pipe for a discharge lamp is disposed in a vertical direction (the Y direction in FIG. 6), and then the upper portion and the lower portion of the glass pipe are supported with a chuck (not shown) so that the glass pipe can be rotated in the direction of the arrow 41. Next, the metal foil 24 having the electrode 12 and the external lead 30 is inserted in the glass pipe, and then the glass pipe is put to be ready for pressure reduction. Then, the pressure in the glass pipe is reduced (e.g., 20 kPa), and the glass pipe is rotated in the directions shown by the arrow 41, and then the glass tube 22 is heated and softened by, for example, a burner 50.

In this case, the glass tube 22 and the metal foil 24 are attached while changing the heating state between the glass portion 22 positioned in the thickness direction of the metal foil 24 and the glass portion 22 positioned in the direction (X direction) perpendicular to the thickness direction by temporarily stopping the rotation of the glass pipe or adjusting the rotation speed. In this manner, the oblate cross-section portion 28 is formed in the sealing portion 20. In this embodiment, the oblate cross-section portion 28 is formed by temporarily stopping the rotation of the glass pipe in the position where the surface of the metal foil 24 faces the burner 50 (the rotation is stopped at every 180°). Alternatively, the oblate cross-section portion 28 can be formed by heating and softening a desired portion of the glass tube 22 by rotating the burner 50 without rotating the glass pipe.

In the discharge lamp of this embodiment, the sealing portion has the oblate cross-section portion 28, so that it is difficult for cracks proceeding from the side face 24*c* of the metal foil 24 to reach the surface of the sealing portion 20. As a result, the sealing structure of the sealing portion can be maintained for a long time over the prior art.

EMBODIMENT 3

Figure 7:
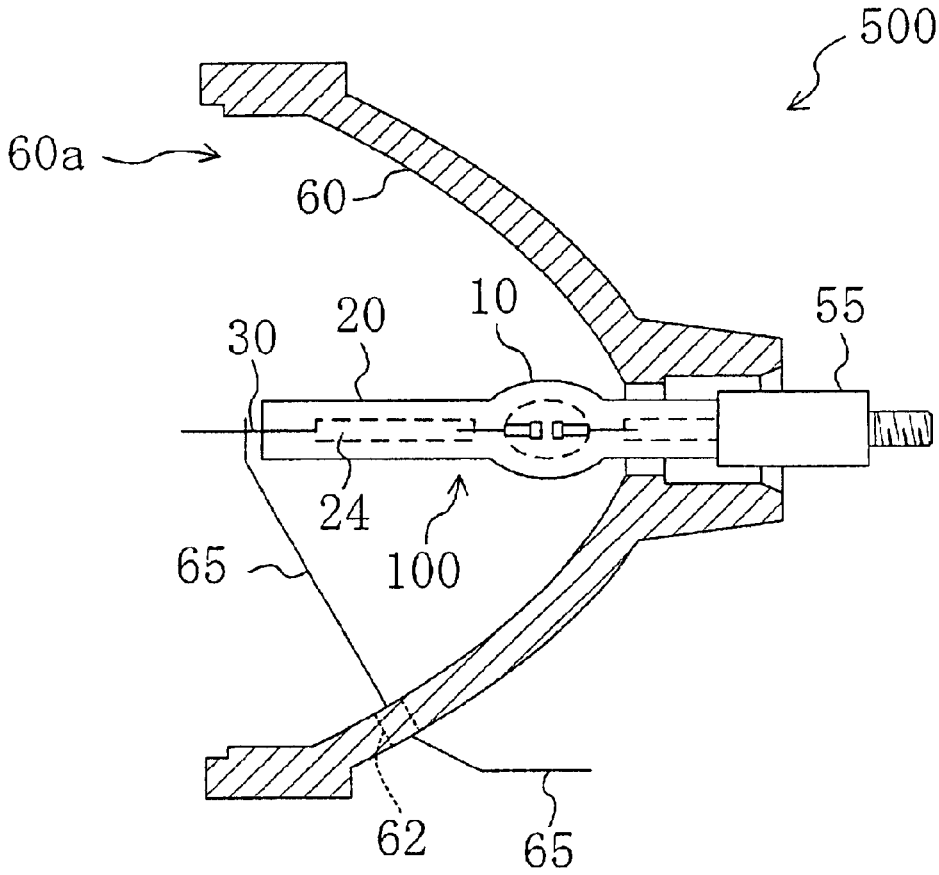
FIG. 7 is a schematic view showing a structure of a lamp unit 500 of Embodiment 3.
Figure 8A:
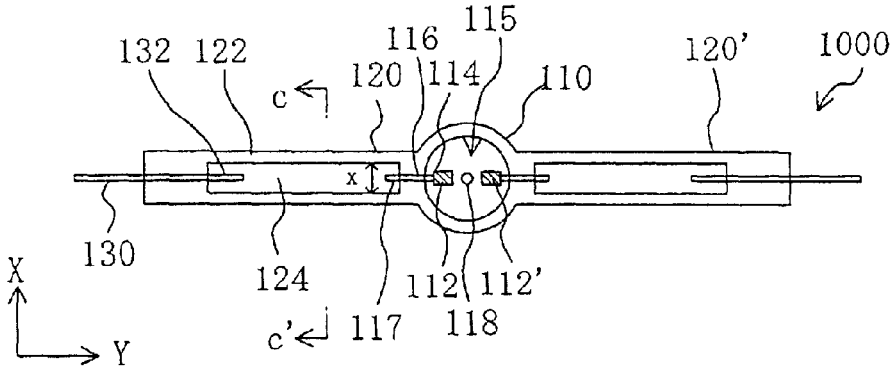
FIG. 8A is a schematic top view showing a structure of a conventional discharge lamp 1000.
Figure 8B:
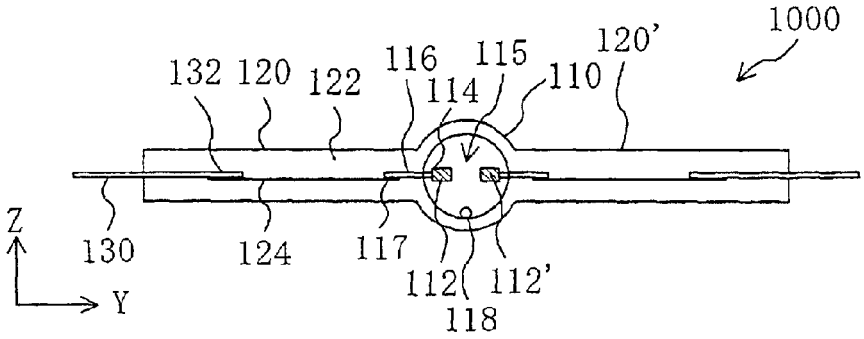
FIG. 8B is a schematic side view showing a structure of a discharge lamp 1000.
Figure 8C:
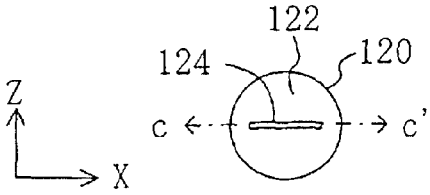
FIG. 8C is a cross-sectional view taken along line c–c' of FIG. 8A.
Figure 9A:
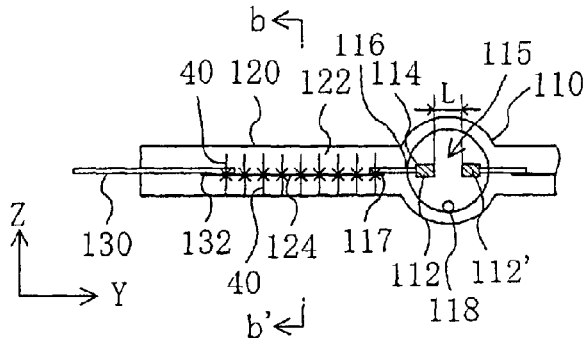
FIGS. 9A, 9B and 9C are views for illustrating the problems of the conventional discharge lamp 1000.
Figure 9B:
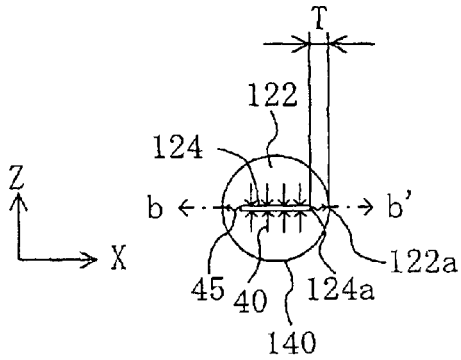
Figure 9C:
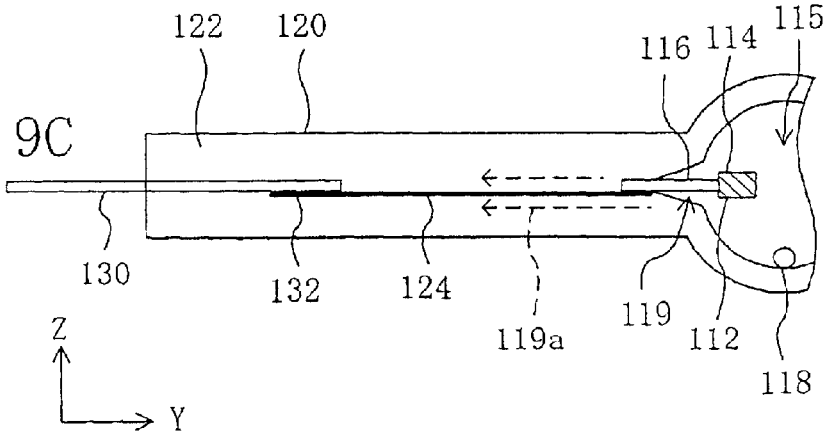

The discharge lamps of Embodiments 1 and 2 can be combined with a reflecting mirror to form a lamp unit. FIG. 7 is a schematic cross-sectional view of a lamp unit 500 including the discharge lamp 100 of Embodiment 1.

The lamp unit 500 includes the discharge lamp 100 including a substantially spherical luminous portion 10 and a pair of sealing portions 20 and a reflecting mirror 60 for reflecting light emitted from the discharge lamp 100. The discharge lamp 100 is only illustrative, and any one of the discharge lamps of the above embodiments can be used. The lamp unit 500 may further include a lamp house holding the reflecting mirror 60.

The reflecting mirror 60 is designed to reflect the radiated light from the discharge lamp 100 so that the light becomes, for example, a parallel luminous flux, a condensed luminous flux converged on a predetermined small area, or a divergent luminous flux equal to that emitted from a predetermined small area. As the reflecting mirror 60, a parabolic reflector or an ellipsoidal mirror can be used, for example.

In this embodiment, a lamp base 55 is attached to one of the sealing portion 20 of the discharge lamp 100, and the external lead 30 extending from the sealing portion 20 and the lamp base 55 are electrically connected. The sealing portion 20 attached with the lamp base 55 is adhered to the reflecting mirror 60, for example, with an inorganic adhesive (e.g., cement) so that they are integrated. A lead wire 65 is electrically connected to the external lead 30 of the sealing portion 20 positioned on the front opening side 60*a* of the reflecting mirror 60. The lead wire 65 extends from the external lead 30 to the outside of the reflecting mirror 60 through an opening 62 for a lead wire of the reflecting mirror 60. For example, a front glass can be attached to the front opening 60*a* of the reflecting mirror 60.

Such a lamp unit can be attached to an image projection apparatus such as a projector employing liquid crystal or DMD, and is used as the light source for the image projection apparatus. The discharge lamp and the lamp unit of the above embodiments can be used, not only as the light source for image projection apparatuses, but also as a light source for ultraviolet steppers, or a light source for an athletic meeting stadium, a light source for headlights of automobiles or the like.

Other Embodiments

In the above embodiments, mercury lamps employing mercury as the luminous material have been described as an example of the discharge lamp of the present invention. However, the present invention can apply to any discharge lamps in which the airtightness of the luminous bulb is maintained by the sealing portion (seal portion). For example, the present invention can apply to discharge lamp enclosing a metal halide such as a metal halide lamp.

In the above embodiments, the mercury vapor pressure is about 20 MPa (in the case of so-called ultra high pressure mercury lamps). However, the present invention can apply to high-pressure mercury lamps in which the mercury vapor pressure is about 1 MPa, or low-pressure mercury lamps in which the mercury vapor pressure is about 1 kPa. Furthermore, the gap (arc length) between the pair of electrodes 12 and 12' can be short, or can be longer than that. The discharge lamps of the above embodiments can be used by any lighting method, either alternating current lighting or direct current lighting.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A discharge lamp comprising:

a luminous bulb in which a luminous material is enclosed and a pair of electrodes are opposed in the luminous bulb; and a pair of sealing portions for sealing a pair of metal foils electrically connected to the pair of electrodes, respectively, each of the pair of sealing portions including a shrink seal structure and each of the pair of metal foils including an external lead on a side opposite to a side electrically connected to a corresponding electrode of the pair of electrodes, wherein at least one of the pair of sealing portions is provided with at least two constricted portions, each of the at least two constricted portions being formed along an outer surface of the at least one sealing portion in an area between an end of the electrode and an end of the external lead, but not formed in an area in which the electrode and the metal foil are connected and not formed in an area in which the external lead and the metal foil are connected.

2. The discharge lamp of claim 1, wherein the length of at least one of the at least two constricted portions in the direction substantially perpendicular to the surface of the metal foil in the sealing portion is 70 to 90% of the length of the other portions without the constricted portion.

3. The discharge lamp of claim 1, wherein one of the other portions is the sealing portion wherein the electrode is disposed.

4. The discharge lamp of claim 2, wherein one of the other portions is the sealing portion where the electrode is disposed.

5. The discharge lamp of claim 1, wherein at least one of the at least two constricted portions is provided in a portion relatively nearer to the luminous bulb side, rather than a center of the sealing portion.

6. The discharge lamp of claim 1, wherein a plurality of constricted portions are formed on the sealing portion.

7. The discharge lamp of claim 1, wherein ends of the pair of sealing portions on a side opposite to the luminous bulb side are tapered.

8. The discharge lamp of claim 1, wherein each of the pair of metal foils is attached tightly to a glass portion extended from the luminous bulb, and wherein each of the pair of the metal foils is a molybdenum foil.

9. The discharge lamp of claim 1, wherein the luminous material comprises at least mercury.

10. The discharge lamp of claim 1, wherein the thickness of a glass portion from a side face of the metal foil to the surface of the constricted portion is at least 2 mm.

11. The discharge lamp of claim 1, wherein cross-sectional shapes of the sealing portion and at least one of the at least two constricted portions are circular, and an outer diameter of the at least one constricted portion is smaller than that of the other portions.

12. A lamp unit comprising the discharge lamp of claim 1, and a reflecting mirror for reflecting light emitted from the discharge lamp.

13. The discharge lamp of claim 1, wherein at least on of the at least two constricted portions is only formed in an area between an end of the electrode and an end of the external lead.

* * * * *

UNITED STATES PATENT AND TRADEMARK OFFICE

CERTIFICATE OF CORRECTION

PATENT NO. : 6,876,151 B2
APPLICATION NO. : 09/824481
DATED : April 5, 2005
INVENTOR(S) : Tomoyuki Seki et al.

It is certified that error appears in the above-identified patent and that said Letters Patent is hereby corrected as shown below:

Column 14

Line 31, Claim 13: "on" should be --one--

Signed and Sealed this

Twenty-fourth Day of October, 2006

JON W. DUDAS
*Director of the United States Patent and Trademark Office*